US007181790B2

(12) United States Patent
Wirtz

(10) Patent No.: US 7,181,790 B2
(45) Date of Patent: Feb. 27, 2007

(54) PROTECTIVE COVER FOR A COMFORTER

(76) Inventor: José Wirtz, 18 Rue Saint Lazare, F-49270 Champtoceaux (FR)

( * ) Notice: Subject to any disclaimer, the term of this patent is extended or adjusted under 35 U.S.C. 154(b) by 122 days.

(21) Appl. No.: 10/516,957

(22) PCT Filed: Apr. 30, 2003

(86) PCT No.: PCT/FR03/01356

§ 371 (c)(1),
(2), (4) Date: Dec. 3, 2004

(87) PCT Pub. No.: WO03/103460

PCT Pub. Date: Dec. 18, 2003

(65) Prior Publication Data

US 2005/0246838 A1 Nov. 10, 2005

(30) Foreign Application Priority Data

Jun. 7, 2002 (FR) ..... 02 06994
Jul. 23, 2002 (FR) ..... 02 09312

(51) Int. Cl.
*A47G 9/02* (2006.01)
*A47G 9/04* (2006.01)

(52) U.S. Cl. ..... 5/501; 5/502; 5/482

(58) Field of Classification Search ..... 5/501, 5/502, 482, 485, 496–500, 490, 737, 738
See application file for complete search history.

(56) References Cited

U.S. PATENT DOCUMENTS 1,865,329 A * 6/1932 McHorter ..... 5/497
1,913,750 A * 6/1933 Frank ..... 5/499
2,454,463 A * 11/1948 Kromer et al. ..... 5/497
2,598,141 A * 5/1952 Simpson ..... 5/497
2,637,049 A * 5/1953 Kromer et al. ..... 5/497
2,994,094 A * 8/1961 Hester ..... 5/497
3,226,737 A * 1/1966 Rote ..... 5/417
3,501,787 A * 3/1970 Nunn ..... 5/496
4,413,368 A * 11/1983 Schuetze ..... 5/494
4,654,906 A * 4/1987 Roberts ..... 5/417
4,703,528 A * 11/1987 Rolle ..... 5/417
4,723,330 A * 2/1988 Kellogg et al. ..... 5/497
5,018,229 A * 5/1991 Eberhart ..... 5/417
5,029,353 A * 7/1991 Kimball et al. ..... 5/497
5,406,659 A * 4/1995 Camp ..... 5/417
5,671,491 A * 9/1997 Ladd ..... 5/417
5,729,847 A * 3/1998 Allardice ..... 5/502

(Continued)

FOREIGN PATENT DOCUMENTS

DE 29922687 U1 * 3/2000

(Continued)

*Primary Examiner*—Robert G. Santos
(74) *Attorney, Agent, or Firm*—Abelman Frayne & Frayne

(57) ABSTRACT

A protective cover for a comforter has a bottom face and a top face which form a flexible woven fabric envelope. The cover is formed from a single-piece envelope including an edge which is at least partly closed in a permanent manner and three edges having fast opening and closing devices allowing the two faces of the envelope to be partly separated in order for the comforter to be placed on one of the faces of the envelope, so that the comforter is covered by the other face and at least two edges of the faces are joined with the aid of the fast opening and closing devices.

9 Claims, 3 Drawing Sheets

U.S. PATENT DOCUMENTS

| | | | | |
|---|---|---|---|---|
| 6,192,536 | B1 * | 2/2001 | Connors | 5/417 |
| 6,286,162 | B1 * | 9/2001 | Huart | 5/482 |
| 2001/0044964 | A1 * | 11/2001 | Phillips | 5/485 |
| 2005/0144721 | A1 * | 7/2005 | Linnane | 5/501 |
| 2005/0246838 | A1 * | 11/2005 | Wirtz | 5/501 |

FOREIGN PATENT DOCUMENTS

| | | | |
|---|---|---|---|
| EP | 853907 | A2 * | 7/1998 |
| FR | 2540718 | A1 * | 8/1984 |
| FR | 2613606 | A1 * | 10/1988 |
| GB | 2023419 | A * | 1/1980 |
| GB | 2047084 | A * | 11/1980 |
| GB | 2312164 | A * | 10/1997 |
| GB | 2318051 | A * | 4/1998 |
| GB | 2321851 | A * | 8/1998 |
| GB | 2332369 | A * | 6/1999 |
| GB | 2366724 | A * | 3/2002 |

* cited by examiner

PROTECTIVE COVER FOR A COMFORTER

CROSS-REFERENCE TO RELATED APPLICATIONS

This application is a 371 of PCT/FR2003/001356, filed on Apr. 30, 2003.

BACKGROUND OF THE INVENTION

1. Field of the Invention

This invention concerns a protective cover for a comforter comprising a bottom face and a top face, which form a flexible woven fabric envelope.

2. Description of the Related Art

Many covers as defined above are known in the state of the art. It is common practice to use comforter covers to keep comforters clean. By changing the cover, users can change the outer appearance such as the fabric, pattern, and color of a comforter as desired. To date, such covers have been in the form of a parallelepiped-shaped fabric sack with one open side through which the comforter is inserted. This open side can in some cases be closed by means of buttons, snaps, or other closure devices.

Problems are often encountered when attempting to insert the comforter into these types of covers. At present, to place the comforter in its cover, the user must insert it through one relatively narrow end and try to match up the corners of the cover to achieve as flat a surface as possible. This technique is time-consuming and frustrating because it is very difficult to position the comforter correctly. The problem is even greater for larger comforters.

Various solutions have been proposed to solve this problem. One solution is to create a central opening in the top face of the cover, as illustrated in particular in patent FR-A-2,799,358 as well as patents GB-A-2,303,062 and DE-A-2,829,873. In this type of cover, certain corners of the cover are still difficult to reach, so the user still wastes time attempting to position at least part of the corners of the comforter so that they match up with the corners of the cover. This operation also requires physical effort on the part of the user.

Another solution consists of making a comforter cover in the form of individual parts, one of which forms a top, and which can be fastened together and separated. This solution is illustrated in particular in document FR-A-2,649,877. In this case, the user wastes time positioning and matching up the top and bottom pieces. If snaps are used, the edges become pleated, especially the longitudinal edges, which results in an unattractive appearance. If zippers are used, the zippers must be matched up each time on all four sides to close the cover completely. Moreover, this type of comforter cover takes up more space when stored.

BRIEF SUMMARY OF THE INVENTION

Thus, one object of this invention is to provide a comforter cover that is easy to put on, since the top and bottom faces of this comforter cover are designed to be partially separated and fastened together easily and quickly, without being bulky.

Another object of this invention is to provide a comforter cover whose appearance is identical to a traditional cover.

Another object of this invention is to provide a comforter cover designed to be reversible.

For this purpose, the invention concerns a protective cover for a comforter. Particular methods for creating the invention are described herein.

The design of this comforter cover, in the form of a single-piece envelope whose top and bottom faces can be partially separated to allow for easy positioning of the comforter without requiring total separation of the faces, facilitates the insertion of a comforter without physical effort for the user.

BRIEF DESCRIPTION OF THE SEVERAL VIEWS OF THE DRAWINGS

The invention will be better understood upon reading the following description and examples made with reference to the accompanying drawings, wherein.

DETAILED DESCRIPTION OF THE INVENTION

Figure 1:
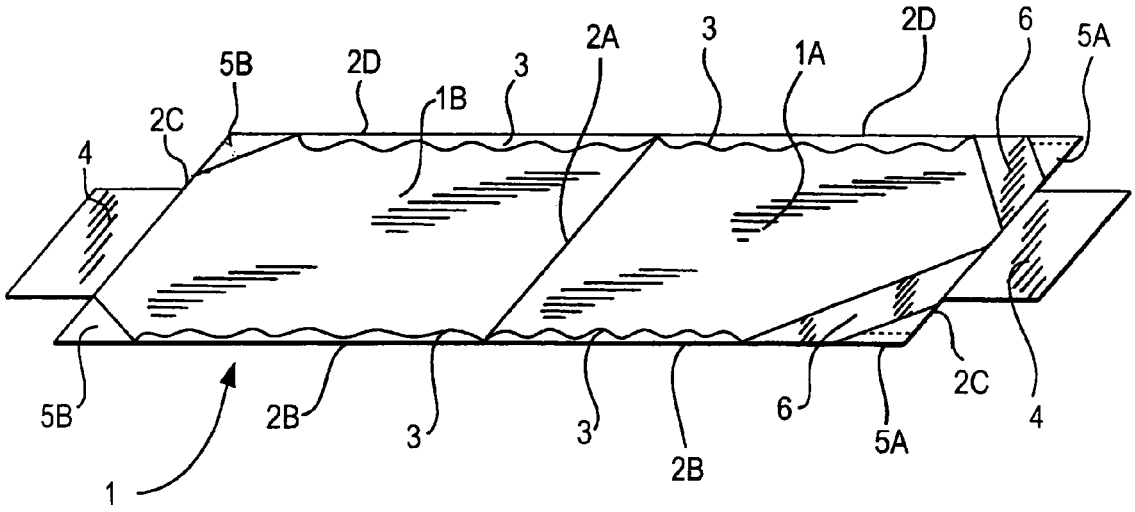
FIG. 1 represents a top view of a comforter cover in accordance with the invention, with the two faces comprising the envelope of the cover separated.

As mentioned above, the protective comforter cover 1 comprises a bottom face 1A and a top face 1B made of flexible fabric so as to form an envelope essentially rectangular or square in shape. This envelope is characterized by the fact that it is in the form of a single-piece envelope comprising a permanently closed edge 2A and three edges 2B, 2C, 2D provided with fast opening and closing devices that allow for partial separation of the two faces 1A, 1B of the envelope such that in the separated state, faces 1A and 1B are an extension of one another as illustrated in FIG. 1. With the cover in this position, the comforter is simply placed on one of the faces, in this case, the bottom face 1A of the cover, then other face is brought up to cover the comforter, in this case the top face 1B of the envelope, and finally the edges 2B, 2C, 2D of the envelope are at least partially closed. In the examples shown, the permanently closed edge of the cover 1 comprises the head edge 2A of the cover 1. Each face 1A, 1B of the cover 1 is provided on its foot edge 2C, opposite head edge 2A of the cover 1, with a flap 4 that can be folded under the mattress to secure the comforter cover and comforter in place. This flap 4 also constitutes at least a partial fast opening and closing device for edge 2C of cover 1. Top face 1B of the cover is also provided, in two of its corners bordering edge 2C on the foot side of the face 1B, with a pocket 5B essentially triangular in shape, which pocket forms a flap to contain the corner bordering edge 2C on the foot edge of bottom face 1A of the cover of the faces 1A, 1B. Thus, flap 4 and pocket 5B constitute the fast opening and closing devices for the edge 2C on the foot side of the cover.

In the examples shown, the cover 1 is reversible. Therefore, each face 1A, 1B of the cover is provided in its two corners bordering the foot edge 2C of cover 1 with a respective pocket 5A, 5B, generally triangular in shape, whose role is to constitute an at least partial fast opening and closing device for the foot edge 2C of the cover of faces 1A, 1B. When faces 1A, 1B of the cover are made of different fabric, each pocket 5A, 5B, attached to one face 1A, 1B of the cover 1, is made of the material constituting the other face of the cover 1. As illustrated in the figures, each pocket 5A, 5B is constituted of a triangular piece added to one face 1A, 1B of the cover 1. One of the edges of the piece is attached to foot edge 2C of the top face or respectively the bottom face, and is attached to the inner wall of this face of the cover. The other edge of the piece is attached to side edge 2B, 2D of the face and is inserted between the fast opening and closing device 3 and the inner wall of the face so as not to interfere with the operation of the fast opening and closing device 3. In the examples shown, side edges 2B, 2D of the cover 1 connecting the head edge 2A and the foot edge 2B of the cover are provided with a zipper 3 concealed by at least one flap overlapping onto the top face of the envelope when the faces 1A, 1B are in the assembled position. In the case of a reversible comforter cover, the element of the zipper on bottom face 1A of the envelope is also positioned on a flap of the bottom face, with this flap being intended to conceal closing device 3.

For this purpose, the top face or respectively the bottom face of the envelope are provided with a fold or a flap to which the zipper is attached. Thus each zipper is sewn to a flap of edge 2B, 2D of one of the faces of the envelope. The fastening stitching is preferably located in the immediate vicinity of the fold line of the flap to allow the flap of the face in question to conceal the entire zipper. The flap may also be provided with a snag guard (not shown). This snag guard is designed to prevent the comforter from getting caught in the zipper when the zipper is closed.

Figure 3:
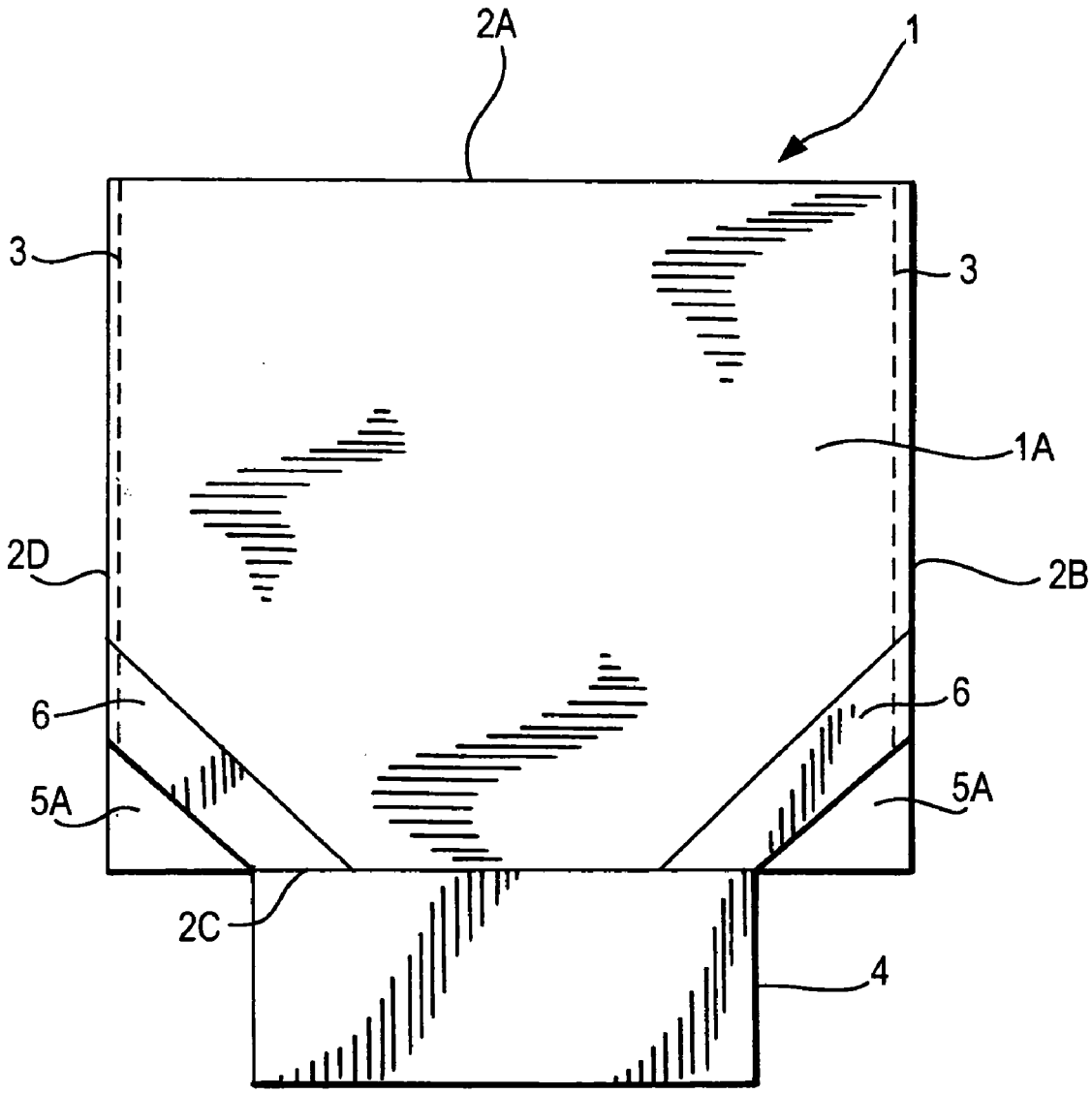
FIG. 3 represent a bottom view of the bottom face of the comforter cover, with the faces separated.

Finally, as illustrated in FIG. 3, one of the faces, in this case the bottom face 1A of the cover, can be provided on the inside, in two of its corners bordering the foot edge 2C of the cover, with an additional pocket 6, generally triangular in shape, into which the foot edge of the comforter is inserted before the edges 2B, 2C, 2D of the cover are joined. This pocket 6 is an additional triangular piece positioned on the inner side of a face. This piece is attached by one of its edges to a side edge 2B or 2D of one face, this edge being covered by the zipper, while another edge of the piece is attached to the foot edge 2C of the cover. The tip of the piece matches up with the tip of the angle formed by edges 2B and 2C or respectively 2B and 2D. This pocket 6 is generally larger in size than pockets 5A or 5B and extends between pocket 5A or 5A and face 1A or 1B as shown in FIG. 3.

Finally, the top face or respectively the bottom face of the cover may be provided on the inside in a predetermined location with a self-gripping closing device (not shown). This closing device is positioned to work with an additional closing device positioned on the comforter.

Figure 2:
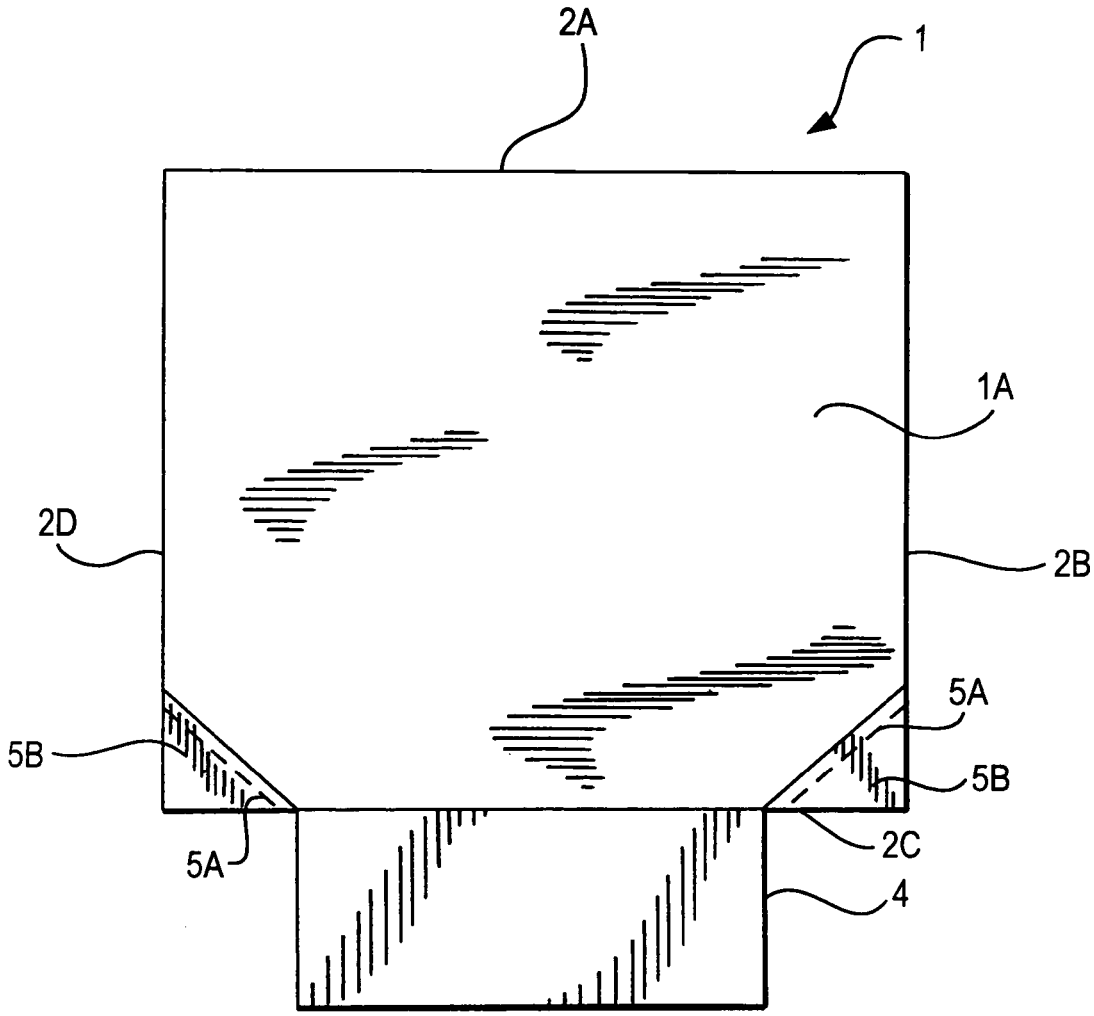
FIG. 2 represents a partial schematic bottom view of the bottom face of the comforter cover with the two faces fastened together.

This comforter cover works as follows: the zippers 3 are opened and faces 1A and 1B of the comforter cover are thus separated to extend out into a position in accordance with FIG. 1. Bottom face 1A of the comforter cover is positioned on the bed. The comforter is then positioned flat on the face. When the additional triangular pockets 6 are present, the corners of the comforter may be inserted into the pockets to help hold the comforter in place on the face 1A. Face 1B is then brought up to cover the comforter such that the face extends parallel to face 1A. Triangular pockets 5B on face 1B of the comforter cover are then folded back to extend over the outer side of face 1B. The zippers 3 may be closed until they reach the vicinity of edge 2C then the triangular pockets 5B are folded back so as to be positioned on the outer side of face 1A as illustrated in FIG. 2. Thus, the corners of bottom face 1A of the comforter are inserted into this pocket 5B, which constitutes a fast opening and closing device for the edge 2C of the cover. When the triangular pockets 5A are also present on bottom face 1A of the envelope, these pockets 5A are also, before the zippers 3 are closed, folded back to extend over the outer side of the top face 1A. They will thus be covered by the pockets 5B so as to be entirely concealed. The flaps 4 are then positioned under the mattress so as to ensure closure of the central area of the edge 2C of the cover. If the comforter cover is reversible, faces 1A, 1B constitute in turn a top face or a bottom face. For this purpose, each face is provided with triangular pockets 5A, 5B in these corners bordering the foot edge 2C of the cover. Thus, when face 1B becomes the bottom face of the comforter, pockets 5A house the corners of face 1B bordering the foot edge 2C of the cover. These pockets 5A cover, on the outer side of face 1B, pockets 5B that have been folded back previously. This is why pockets 5A, attached to face 1A of the cover, are made of a material matching the material used on face 1B of the cover, and likewise, pockets 5B, attached to face 1B of the cover, are made of the a material matching the material used on face 1A of the cover. These pockets 5A, 5B thus ensure continuity in the pattern of the face that they cover when the faces are fastened together. Thus, flaps 4 and pockets 5A or 5B constitute the fast opening and closing devices for edge 2C of the cover. This cover thus presents the appearance of a cover in accordance with the state of the art, while its design makes it possible to readily insert the comforter into the cover.

What is claimed is:

1. A protective cover (1) for a comforter, comprising:

a bottom face (1A);

a top face (1B);

wherein the bottom face (1A) and the top face (1B) form a flexible, woven fabric envelope as a single-piece envelope including:

a permanently closed edge (2A) which is at least partly closed in a permanent manner; and three edges (2B, 2C, 2D), including an openable foot edge (2C) and side edges (2B, 2D), which are provided with fast opening and closing means (3, 4, 5A, 5B), with the fast opening and closing means (3, 4, 5A, 5B) including a zipper (3), a flap (4), and triangular pockets (5A, 5B), allowing the two faces (1A, 1B) of the envelope to be partly separated in order for the comforter to be placed on one face (1A) of the faces (1A, 1B) of the envelope, whereupon the comforter is covered by the other face (1B) and the three edges (2B, 2C, 2D) of the faces (1A, 1B) are joined by the fast opening and closing means (3, 4, 5A, 5B);

wherein the top face (1B) of the cover (1) is provided, in two of its corners bordering the openable foot edge (2C) of the top face (1B), with the triangular pocket (5B), with the triangular pocket (5B) forming a flap to contain the corner bordering the openable foot edge (2C) of bottom face (1A) of the cover, and the fast opening and closing means (3, 4, 5A, 5B) providing at least partial closure of the openable foot edge (2C) of the faces (1A, 1B) of the cover (1).

2. The protective cover (1) for a comforter according to claim 1, wherein each face (1A, 1B) of the cover (1) is provided on its openable foot edge (2C) of the cover (1) with the flap (4) that can be folded under a mattress to secure the cover (1) and the comforter in place.

3. The protective cover (1) for a comforter according to claim 2, wherein the cover (1) is reversible, with each face (1A, 1B) of the cover being provided in its two corners bordering the openable foot edge (2C) of the cover (1) with the triangular pockets (5A, 5B).

4. The protective cover (1) for a comforter according to claim 1, wherein each of the triangular pockets (5A, 5B) attached to a respective face (1A, 1B) of the cover (1) is made of the material constituting the other face of the cover (1).

5. The protective cover (1) for a comforter according to claim 1, wherein each triangular pocket (5A, 5B) includes a triangular piece attached to a respective face (1A, 1B) of the cover (1), with one of the edges of the triangular piece being attached to the openable foot edge (2C) of the respective face (1A, 1B) of the cover (1), the other edge of the piece being attached to the side edges (2B, 2D) of the face and inserted between the fast opening and closing means (3) and the wall of the face so as not to interfere with the operation of the fast opening and closing means (3).

6. The protective cover (1) for a comforter according to claim 1, wherein the permanently closed edge (2A) of the cover (1) includes the head edge of the cover (1).

7. The protective cover (1) for a comforter according to claim 1, wherein the side edges (2B, 2D) of the cover (1) connecting the permanently closed edge (2A) and the openable foot edge (2C) of the cover (1) are provided with the zipper (3) concealed by at least one flap overlapping onto the top face of the envelope when the faces (1A, 1B) are in the assembled position.

8. The protective cover (1) for a comforter according to claim 1, wherein one of the faces (1A, 1B) of the cover (1) is provided on the inner side, in two of its corners bordering the openable foot edge (2C) of the cover (1), with an additional triangular pocket into which the openable foot edge (2C) of the comforter is inserted.

9. The protective cover (1) for a comforter according to claim 1, wherein at least one of the top face (1B) or the bottom face (1A) of the cover (1) is provided on the inside in a predetermined location with a self-gripping closing device, with the self-gripping closing device being positioned to work with a second closing device positioned on the comforter.

* * * * *